US010675666B2

(12) United States Patent
Jaubert

(10) Patent No.: US 10,675,666 B2
(45) Date of Patent: Jun. 9, 2020

(54) DEVICE FOR BENDING PROFILE MEMBERS COMPRISING TOOLS FOR BENDING PROFILE MEMBERS AND A TOOL FOR CUTTING SAID PROFILE MEMBERS

(71) Applicant: ADMC HOLDING, LLC, Lebanon, OH (US)

(72) Inventor: Philippe Jaubert, Cologne (FR)

(73) Assignee: ADMC HOLDING, LLC, Lebanon, OH (US)

( * ) Notice: Subject to any disclaimer, the term of this patent is extended or adjusted under 35 U.S.C. 154(b) by 140 days.

(21) Appl. No.: 15/742,966

(22) PCT Filed: Jun. 23, 2016

(86) PCT No.: PCT/FR2016/000106
§ 371 (c)(1),
(2) Date: Jan. 9, 2018

(87) PCT Pub. No.: WO2016/207499
PCT Pub. Date: Dec. 29, 2016

(65) Prior Publication Data

US 2018/0354011 A1 Dec. 13, 2018

(30) Foreign Application Priority Data

Jun. 24, 2015 (FR) ..... 15 01324

(51) Int. Cl.
*B21D 7/024* (2006.01)
*B26D 3/16* (2006.01)
*B21D 7/02* (2006.01)

(52) U.S. Cl.
CPC ..... *B21D 7/024* (2013.01); *B21D 7/02* (2013.01); *B26D 3/16* (2013.01); *B26D 3/161* (2013.01)

(58) Field of Classification Search
CPC ..... B21D 7/02; B21D 7/024; B21D 7/022; B21D 7/03; B21D 43/02; B21D 43/28; B21D 43/028; B21D 11/203; B26D 3/161
See application file for complete search history.

(56) References Cited

U.S. PATENT DOCUMENTS 5,927,124 A * 7/1999 Webster ..... B21D 7/024 72/131
7,159,430 B2 * 1/2007 Yogo ..... B21D 7/024 72/129
10,086,424 B2 * 10/2018 Carruthers ..... B21D 7/04
(Continued)

FOREIGN PATENT DOCUMENTS

| | | |
|---|---|---|
| EP | 1591175 | 11/2005 |
| FR | 3001163 | 7/2014 |
| WO | WO2015028724 | 3/2015 |

*Primary Examiner* — Pradeep C Battula
(74) *Attorney, Agent, or Firm* — Welsh Flaxman & Gitler LLC

(57) ABSTRACT

The invention relates to a device for bending profile members in which the bending head includes at least one stage for bending the profile members and cutting the profile members after bending, provided with a tool for cutting the profile members including a pre-cutting member suitable for starting the cutting of the profile members, and a cutting member suitable for finishing the cut started by the pre-cutting member.

10 Claims, 9 Drawing Sheets

(56) References Cited

U.S. PATENT DOCUMENTS

| | | | | |
|---|---|---|---|---|
| 2006/0112752 | A1* | 6/2006 | Hu | B21D 7/024 72/307 |
| 2010/0223971 | A1* | 9/2010 | Jaubert | B21D 7/024 72/149 |
| 2016/0023259 | A1* | 1/2016 | Jaubert | B21D 7/024 72/129 |
| 2016/0311086 | A1* | 10/2016 | Christofilis | B21D 7/16 |

* cited by examiner

DEVICE FOR BENDING PROFILE MEMBERS COMPRISING TOOLS FOR BENDING PROFILE MEMBERS AND A TOOL FOR CUTTING SAID PROFILE MEMBERS

BACKGROUND OF THE INVENTION

The invention relates to a device for bending profiles such as tubes, having, on the one hand, tools for bending the profiles, and, on the other hand, a tool for cutting these profiles after bending.

Usually, the current bending devices are designed to move the profiles along a longitudinal axis (X) and have a bending die mounted on means for driving the bending die in rotation around a bending axis (Z), provided, on the one hand, with one or more bending section(s) each equipped with a bending form/clamping jaw assembly, and, on the other hand, with a section for cutting bent profiles that is separate from the bending sections.

Usually, in addition, each bending section has, to achieve the bending operations:

- at least one bending form oriented on the bending axis (Z), provided with a peripheral groove for winding the profile that extends in the continuity of an impression intended for the clamping of the profile,
- associated with each bending form, a clamping jaw having a clamping impression of the complementary profile of the impression of the bending form,
- means for moving each clamping jaw along a so-called transverse axis (Y) relative to the associated bending form, between a clamping position coupled to the bending form and an open position separated from this bending form.

One of the drawbacks of these bending devices results from the fact that the bending sections and the cutting section are separate, so that the cutting operations necessitate transferring the profiles from a bending section to the cutting section.

Now, this solution in particular goes against the objectives that are sought during the design of such bending devices that aim to optimize the time of a complete machining cycle of a profile.

To remedy this drawback, a solution particularly described in the patent European Patent No. 1 591 175 consisted in making a bending device having:

- at least one clamping jaw, called a blank holder jaw, pierced with a through hole that opens out through a slot in the impression of the clamping jaw,
- associated with each blank holder jaw, a bending form pierced with a through hole that opens out through a slot in the impression of the bending form, and arranged so as to extend in the continuity of the through hole of the blank holder jaw,
- a cutting element associated with each blank holder jaw/bending form pair, having one cutting end forming at least one cutting tip extending into the plane (X, Y),
- means for moving the cutting element along the transverse axis (Y) between an active cutting position of a profile housed in the impressions of the associated blank holder jaw/bending form pair, and a passive position, called a bending position, in which the cutting element is retracted back in relation to the impressions.

This solution actually leads to optimizing the time of a complete machining cycle of a profile, but it turns out, in contrast, that the cutting operation frequently leads to "tearing" certain areas of the cutting. Because of this, it is frequently obligatory to proceed to an additional machining of the cut end of the profile to obtain a clean and straight cut, which wipes out any benefit resulting from the optimization of the bending/cutting cycle time.

SUMMARY OF THE INVENTION

This invention aims to remedy this drawback and has as its main object to provide a bending device designed so as to reduce the time of the final cutting step of this profile, and to achieve, during this final step, a clean and straight cutting of the profile.

For this purpose, the object of the invention is a bending device of the type described in the preamble above, comprising, in addition, associated with each blank holder jaw/bending form pair, a second cutting element, called a pre-cutting element, designed to be activated before the cutting element, and having a cutting end that forms at least one cutting tip, and means for moving this pre-cutting element in the plane (Y, Z):

- between two positions in each of which the pre-cutting element clears the access to the slot that opens out into the impression of the blank holder jaw,
- along a suitable path so that each cutting tip penetrates into the impression of the blank holder jaw through the slot, by a depth designed to achieve a beginning of the cutting of the profile at least in the vicinity of the generatrix of the latter that extends in the plane (X, Y),
- the blank holder jaw having, communicating with the impression of the blank holder jaw through the slot opening out into the latter, a channel designed to ensure the guiding of the pre-cutting element during the movement of the latter,
- and the means for moving the cutting element being designed to determine a bending position in which the cutting element is retracted back from the guiding channel of the pre-cutting element.

According to the invention, each bending/cutting section is therefore equipped with a pre-cutting element and with a cutting element and is designed to make it possible to activate these two elements successively so as to perform a beginning of the cutting in a specific zone of the profile and then the total cutting of this profile.

In practice, such a combined action of pre-cutting and cutting leads, given a slight increase in the corresponding cycle time at the time of execution of the pre-cutting, to achieving a straight and clean cutting of the profiles that does not necessitate any subsequent machining.

According to an advantageous embodiment of the invention, the means for moving each pre-cutting element are designed to move the latter along a circular path centered on a point located on the transverse axis (Y).

Such a path leads, actually, during the pre-cutting, to removing the most material in the vicinity of the generatrix of the profiles that extends into the plane (X, Y), i.e., in the area of the zone then "attacked" by the cutting element.

Furthermore, according to an advantageous embodiment of the invention, to ensure the guiding of the pre-cutting element along this circular path, the guiding channel of the pre-cutting element is delimited, along the transverse axis (Y), by a convex wall forming a guiding range of the pre-cutting element, pierced with a slot extending into the plane (Y, Z), for guiding the cutting element.

According to a first advantageous variant embodiment of the invention, the means for movement of each blank holder jaw are separated from the activation means of the cutting elements and for this purpose:

the means for moving each blank holder jaw have a carriage on which the blank holder jaw is mounted, and means for moving in translation the carriage along the transverse axis (Y), the cutting element and the pre-cutting element are mounted on the carriage and are associated with movement means that are able to move them along the transverse axis (Y) relative to the carriage.

Furthermore, according to this first variant embodiment and advantageously according to the invention:

the cutting element is carried by a holder block associated with means for moving the holder block along the transverse axis (Y) relative to the carriage, the means for moving the pre-cutting element comprise a connecting rod system connecting the pre-cutting element to a roller that works with a cam mounted on the holder block.

Furthermore, the cam consists advantageously, according to the invention, of a cam with groove designed to be extended laterally in relation to the cutting element, between the holder block and the blank holder jaw, with the connecting rod system having a crankshaft able to transform the translational movement of the roller guided by the cam with groove into a rotational movement of the pre-cutting element.

According to a second advantageous variant embodiment of the invention, the means for moving each blank holder jaw are designed to produce also the movements of the cutting element, and these movement means are, further, separated from the means for activating the pre-cutting element. For this purpose, according to the invention, and firstly, each blank holder jaw is coupled to support means:

with which are associated the means for moving the blank holder jaw along the transverse axis (Y), on which the cutting element is mounted, to which the blank holder jaw is connected by retractable connecting elements between a retracted state in which the cutting element is in its active cutting position and a deployed state in which the cutting element is in its retracted passive position.

Furthermore, secondly, according to the invention, the pre-cutting element is associated with movement means comprising an actuator designed to produce the movements of the pre-cutting element.

Furthermore, according to this second variant embodiment and advantageously according to the invention, means for controlling the actuator are designed to control a movement of the pre-cutting element along an outward path, to perform the pre-cutting, and then to control the movement along the return path, after activating the cutting element.

In addition, the actuator consists, advantageously according to the invention, of a fluid cylinder coupled respectively to the support means of the cutting element and to the blank holder jaw, and designed, on the one hand, so that its deployment produces a movement along the outward path of the pre-cutting element, and, on the other hand, so as to exert a stop force against the blank holder jaw, firstly in its deployed state, and secondly during its retraction and its deployment resulting from the movements of the support means of the cutting element relative to the blank holder jaw, producing the cutting of the profile.

As will be better understood upon reading the detailed description that follows, these arrangements make it possible to ensure the retraction of the cutting element after the activation of the latter.

According to another advantageous embodiment relative to the second variant embodiment of the invention:

each cutting element is carried by a carriage coupled to a holder block with which the means for moving the blank holder jaw along the transverse axis (Y) are associated, the retractable connecting elements placed between each blank holder jaw and the support means of the cutting element comprise:

at least one cylinder, called a stop cylinder, extending longitudinally between the blank holder jaw and the holder block, a cylinder called a cutting cylinder, designed to rest against the carriage carrying the cutting element so as, during its deployment, to exert on the carriage a force that tends to loosen it from the holder block, means for feeding the cutting cylinder and each stop cylinder, consisting of a closed circuit designed so that the cutting cylinder and each stop cylinder are fed inversely.

BRIEF DESCRIPTION OF THE DRAWINGS

Other characteristics, objects and advantages of the invention will emerge from the detailed description that follows with reference to the accompanying drawings that represent by way of nonlimiting examples two preferential embodiments of it.

DETAILED DESCRIPTION OF THE INVENTION

Figure 9A:
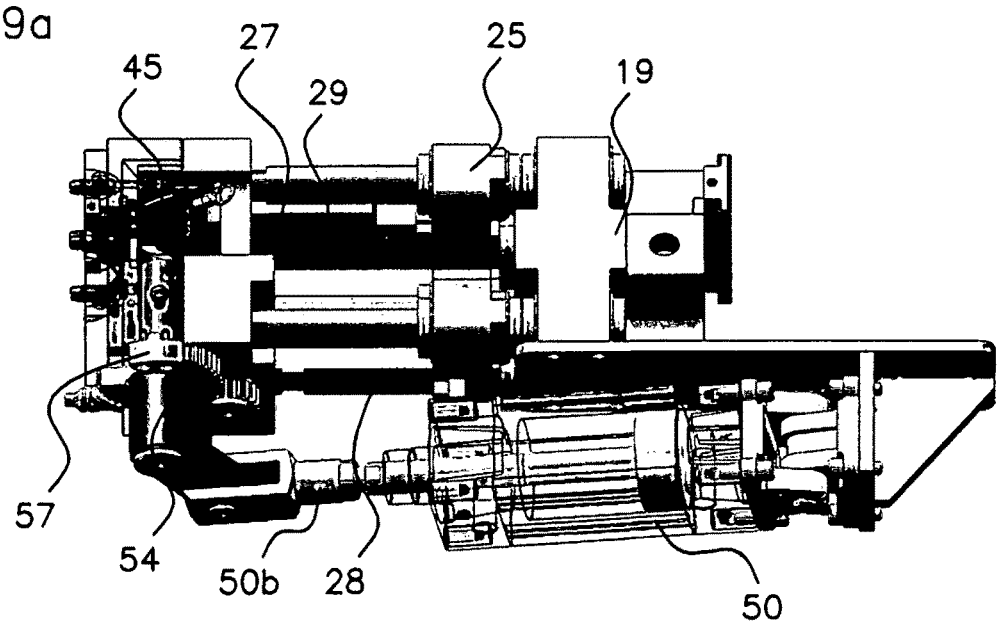
FIGS. 9*a*-9*c* are perspective views representing three steps of the operation of this blank holder jaw/support means assembly.
Figure 9B:
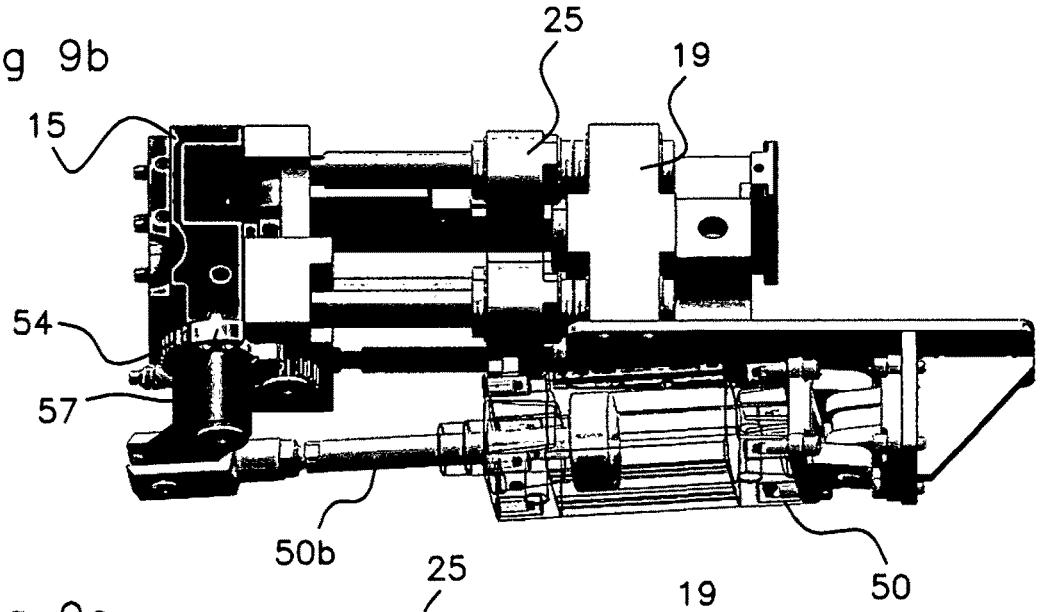
Figure 9C:
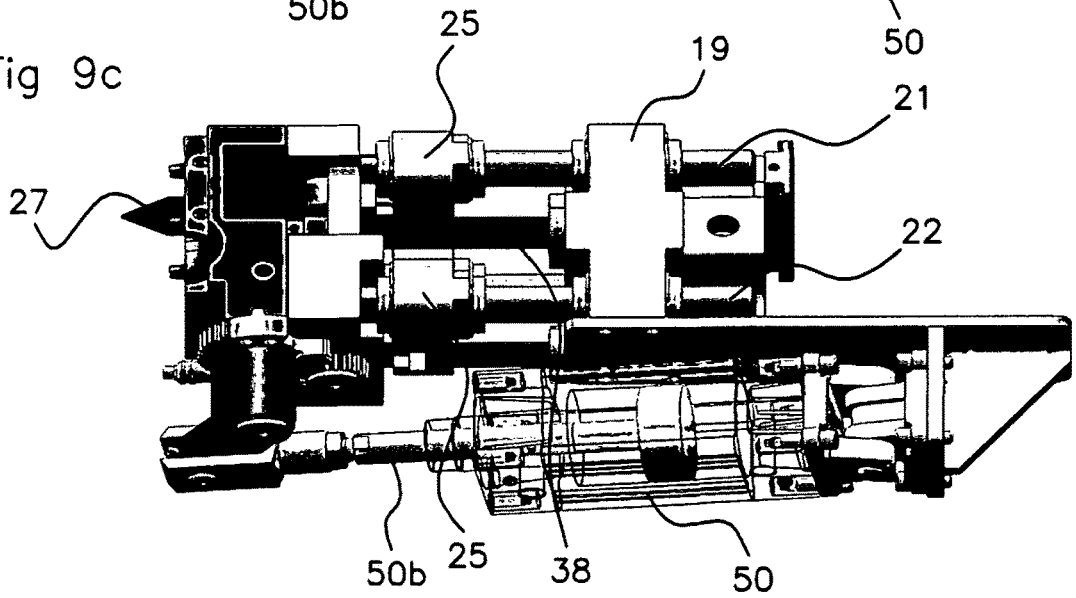
Figure 10:
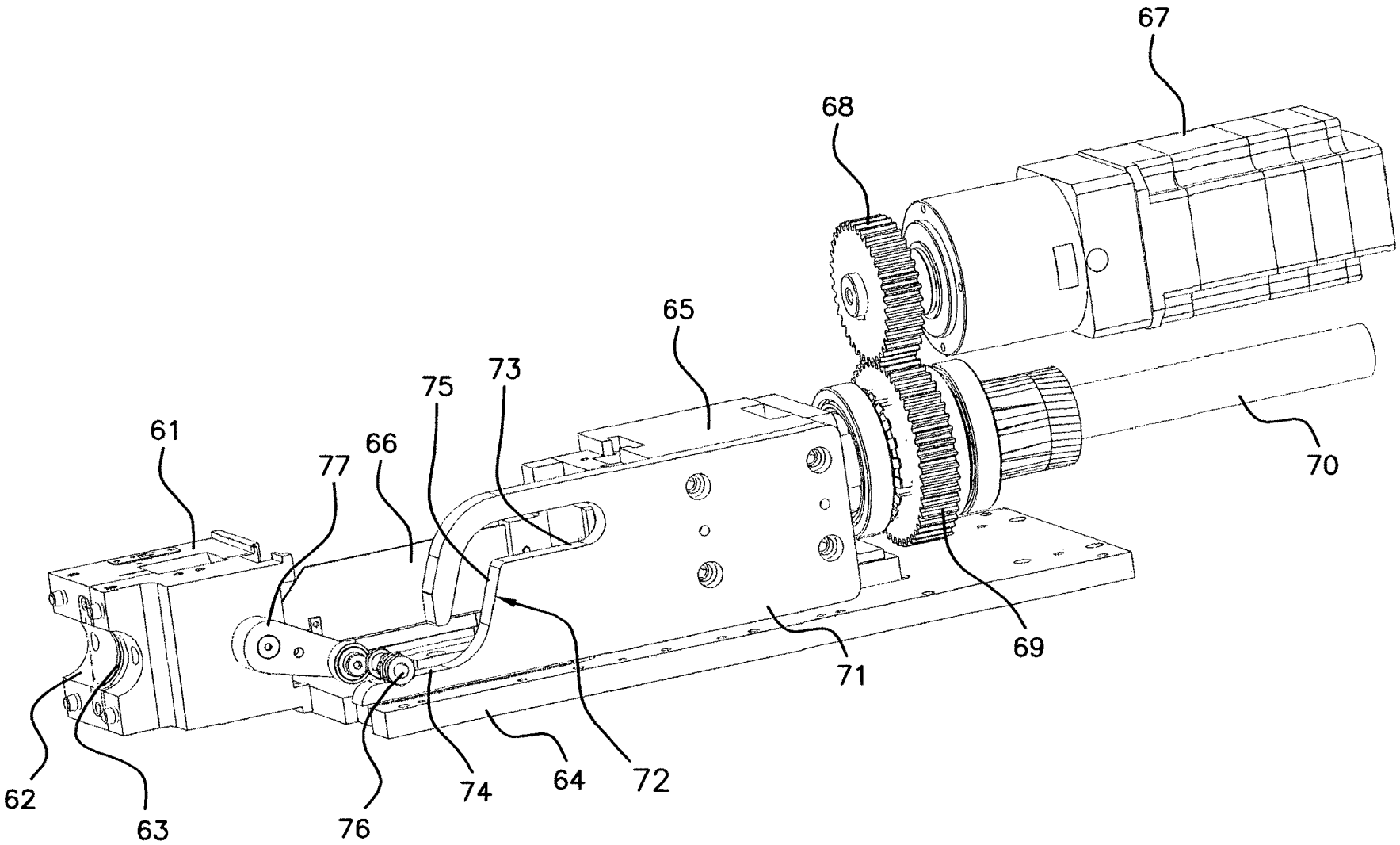
FIG. 10 is a view in perspective of a blank holder jaw/support means assembly of this blank holder jaw according to a second variant embodiment of a bending device according to the invention.

The bending devices according to the invention, represented by way of examples respectively in FIGS. 1 to 9 and in FIG. 10, consist of machines for bending a profile carried by movement means (not shown) that are able to move it along a horizontal movement axis (X), and having, for example, either a gripper associated with means for driving the latter along the longitudinal axis (X), or a 6-axis robot of the type described in the patent FR2914203.

It should be noted that, for purposes of simplifying the detailed description that follows, the bending die is described in its initial position of loading a profile in which the clamping impressions of the bending form and of the blank holder jaw are oriented on the longitudinal axis (X) for moving the profiles, and the transverse axis (Y) for moving the blank holder jaw is at right angles to this longitudinal axis (X).

According to the two embodiments represented in the figures, the bending die comprises, firstly, a slide plate 1 having a longitudinal groove 2 for support and guiding of the profiles, carried by means (not shown) for moving the slide plate along a longitudinal axis parallel to the axis (X) and along a horizontal transverse axis (Y) at right angles to the plane (X, Z), (the axis Z representing the bending axis consisting of the axis of rotation of the bending die that is at right angles to the axis X).

This bending die also has a wrinkle-eraser 3 provided with a guiding groove, intended to work with the slide plate 1 for the support and guiding of the profiles.

This wrinkle-eraser 3 is coupled to the bending form of this bending die that has, firstly, a cylindrical roller 4 that is secured on a circular plate 5 designed to be mounted on means (not shown) for driving the cylindrical roller 4 in rotation around the bending axis (Z).

This cylindrical roller 4 is provided with a peripheral groove 7 and has a notch 6 with an L-shaped cross-section delimited by two perpendicular walls and extending in the area of the plate 5.

In addition, a groove 8 extending along an axis parallel to the axis (Z) is made in the wall of the notch 6 parallel to the axis (X), the groove housing the upright of a T-shaped rail 9.

This rail 9 is intended for the positioning, in the notch 6, of a rectangular parallelepiped-shaped clamping jaw 10, called a counter-clamping jaw, provided in particular with:

- a front face 10*a* in which a clamping impression 11 is made,
- an opposite front face 10*c* in which a T-shaped groove 12 is made that is designed to house the rail 9, in a position where one of the transverse faces of this counter-clamping jaw 10 is flattened against the adjacent wall of the notch 6.

According to the example shown, the impression 11 forms, in addition, an elbow of 90° provided with a branch 11*a* oriented on the longitudinal axis (X) and with a branch 11*b* perpendicular to the longitudinal axis (X).

Moreover, the counter-clamping jaw 10 is pierced with a through slot 13 that extends between the front faces 10*a*, 10*c* so as to open out, on the one hand, into the branch 11*a* of the impression 11, and, on the other hand, into the groove 7 of the cylindrical roller 4.

Finally, concerning this counter-clamping jaw 10, the front face 10*a* is pierced with four blind holes, so-called centering holes, such as 14, each made in the area of one of the corners of this front face 10*a*.

The bending die according to the invention also has a clamping jaw, called a blank holder jaw, of the same shapes and dimensions as the counter-clamping jaw 10.

According to the embodiment shown in FIGS. 2 to 9, this blank holder jaw 15 has a front face 15*a* in which a clamping impression 16 is made that is coupled with the impression 11 and that therefore has the shape of an elbow formed with two perpendicular branches 16*a*, 16*b*.

Furthermore, this blank holder jaw 15 is pierced with a through slot 17 that extends between its front faces so as to open out into the branch 16*a* of the impression 16, in the continuity of the slot 13 made in the counter-clamping jaw 10.

In addition, this blank holder jaw 15 has four centering pins such as 18 that are designed to be housed in the centering holes 14 of the clamping jaw 10 during the coupling of these two elements.

This blank holder jaw 15 is associated with a holder block 19 that is approximately cube-shaped and designed to be mounted on means (not shown) for moving the blank holder jaw 15/holder block 19 assembly along a so-called transverse axis (Y) relative to the bending form 10. For this mounting, this holder block 19 has, opposite the blank holder jaw 15, a front face in which a rib is made that is able to house a rail 20 for catching the holder block.

Furthermore, the connection between the blank holder jaw 15 and the holder block 19 is assured by means of three rods 21-23:

- integral with the face of the blank holder jaw 15 opposite the impression 16 so as to extend, along a transverse axis (Y), into the rear extension of the blank holder jaw,
- mounted to slide inside ball bushings such as 24 that are integral with the holder block 19.

The bending device further has a carriage 25 coupled with the holder block 19, between the latter and the blank holder jaw 15, on the one hand, equipped with ball bushings such as 26 arranged to make it possible for the carriage to slide along the rods 21-23, and, on the other hand, on which a cutting blade 27 is secured that has an end segment in the shape of a point oriented on the plane (X, Y), embedded in the front face of the carriage 25 opposite the holder block 19 so as to extend at right angles in relation to the latter.

This bending device, moreover, has three hydraulic stop cylinders 28-30 positioned between the blank holder jaw 15 and the holder block 19, comprising a cylinder rod 31 provided with a threaded end 31*a* for securing the rod to the blank holder jaw 15, and with an opposite end forming a piston 32 housed in a cylinder chamber 33 made longitudinally in the holder block 19.

The three chambers 33 are, further, fed, from connecting holes 34-36, by ducts such as 37 that connect, on the one hand, the holes, and, on the other hand, the three chambers 33.

The bending device also has a cutting cylinder 38 designed to draw the carriage 25 so as, during its deployment, to exert on the carriage a force that tends to clear it from the holder block 19.

For this purpose, this cutting cylinder 38 has a rod 39 provided with an end that forms a piston 40 housed in a cylinder chamber 41 made longitudinally in the holder block 19, so as to open out opposite the carriage 25, and fed from a connecting hole 42.

Figure 8:
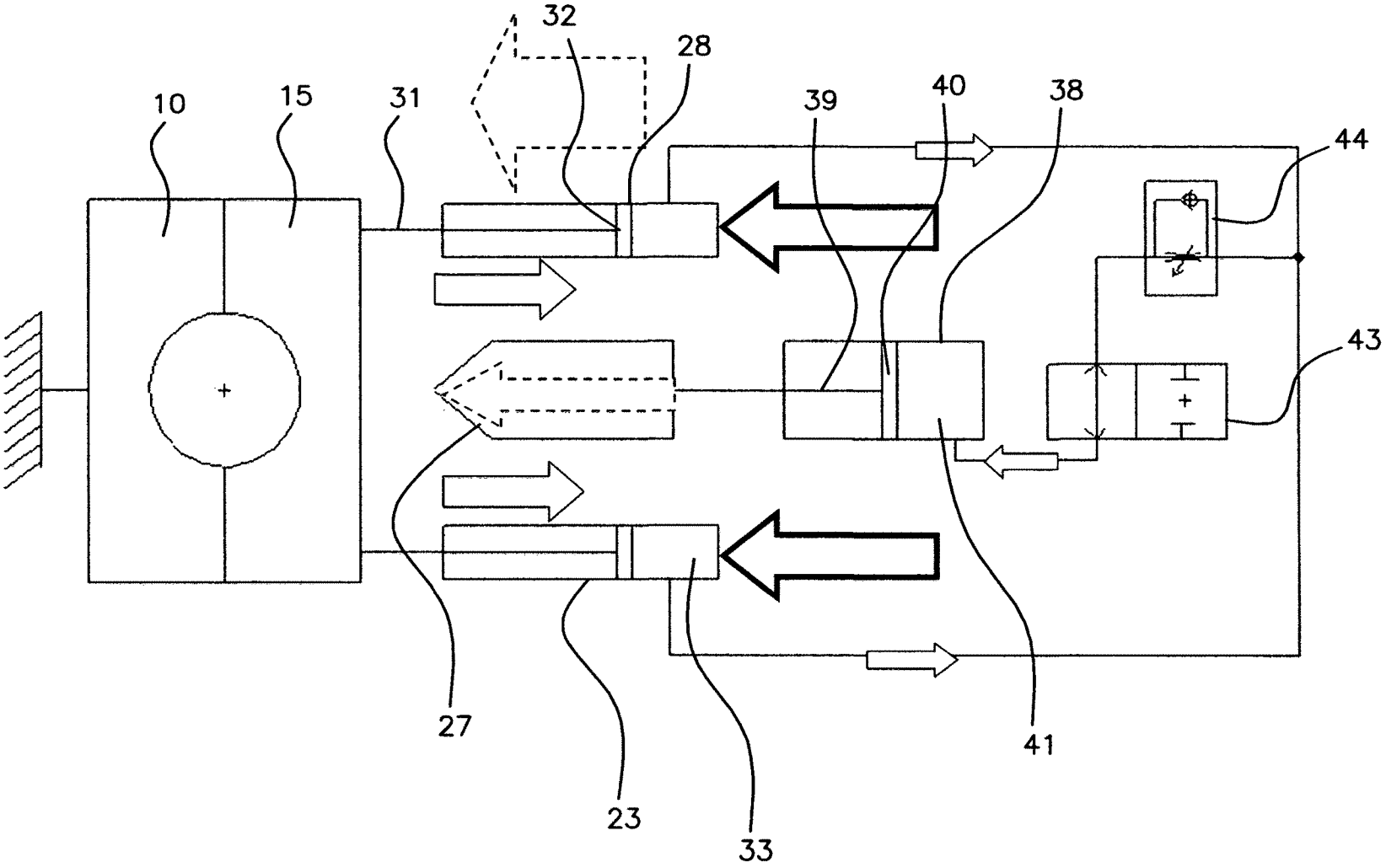
FIG. 8 is a diagram of the feeding circuit of this blank holder jaw/support means assembly.

In addition, according to the invention, as shown in FIG. 8, the three stop cylinders 28-30 and the cutting cylinder 38 are connected so as to form a closed hydraulic circuit incorporating a distributor 43 and a unidirectional flow reducer 44.

Such a closed hydraulic circuit is designed, firstly, in a first position of the distributor 43, to maintain, under fluid pressure, the stop cylinders 28-30 in their deployed position, making it possible in particular to bend in a usual way a profile held clamped between the counter-clamping jaw 10 and the blank holder jaw 15.

A switching of the distributor 43 performed to begin the cutting operation leads, by contrast, to making possible the emptying of the chamber 33 of each of the stop cylinders 28-30, during the movement of the holder block 19 caused by the means for moving the block holder jaw 15/holder block 19 assembly along a so-called transverse axis (Y) relative to the bending form 4, 10.

The flow of fluid during this emptying is, in addition, regulated by the flow reducer 44, so that the blank holder jaw 15 is held applied against the counter-clamping jaw 10 with a pressing force that is determined by this flow reducer 44, thus imparting to the blank holder jaw a flap press function that makes possible the cutting of the profile by means of the cutting blade 27.

Finally, during the cutting, a force is applied on the carriage 25 by the cutting cylinder 38, thus facilitating the cutting operation.

Figure 2:
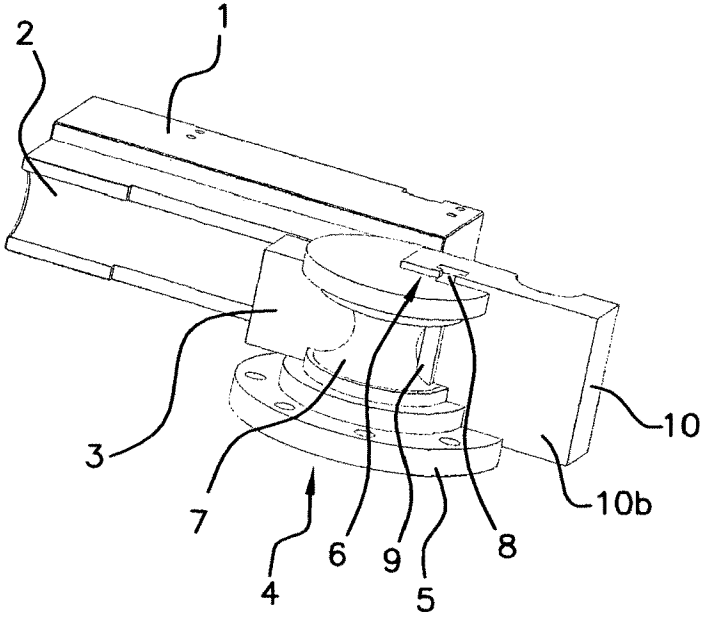
FIG. 2 is a view in perspective, according to a second viewing angle, of this bending form and of these guiding elements.
Figure 1:
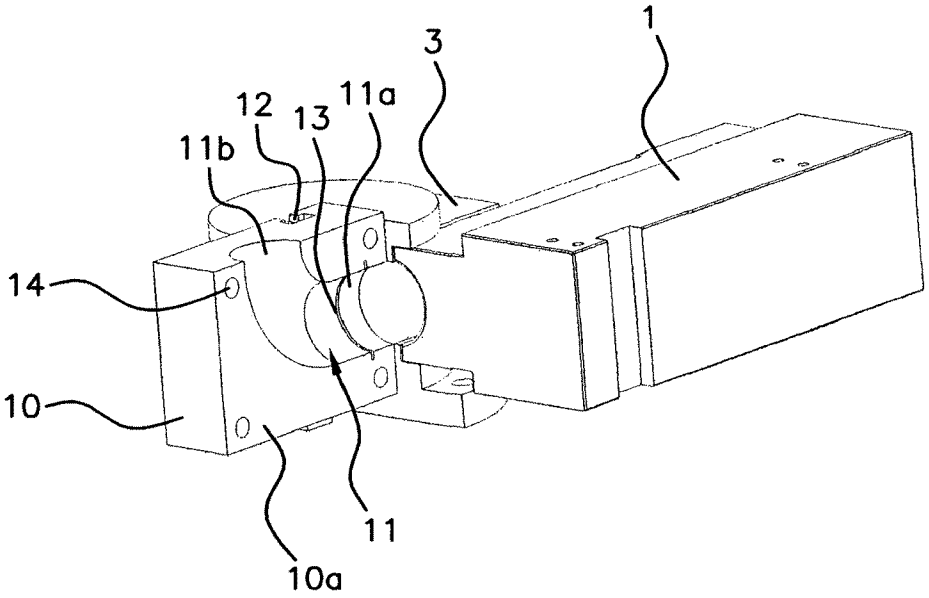
FIG. 1 is a view in perspective, according to a first viewing angle, of a bending form and guiding elements of a profile equipping a bending die according to the invention.
Figure 3:
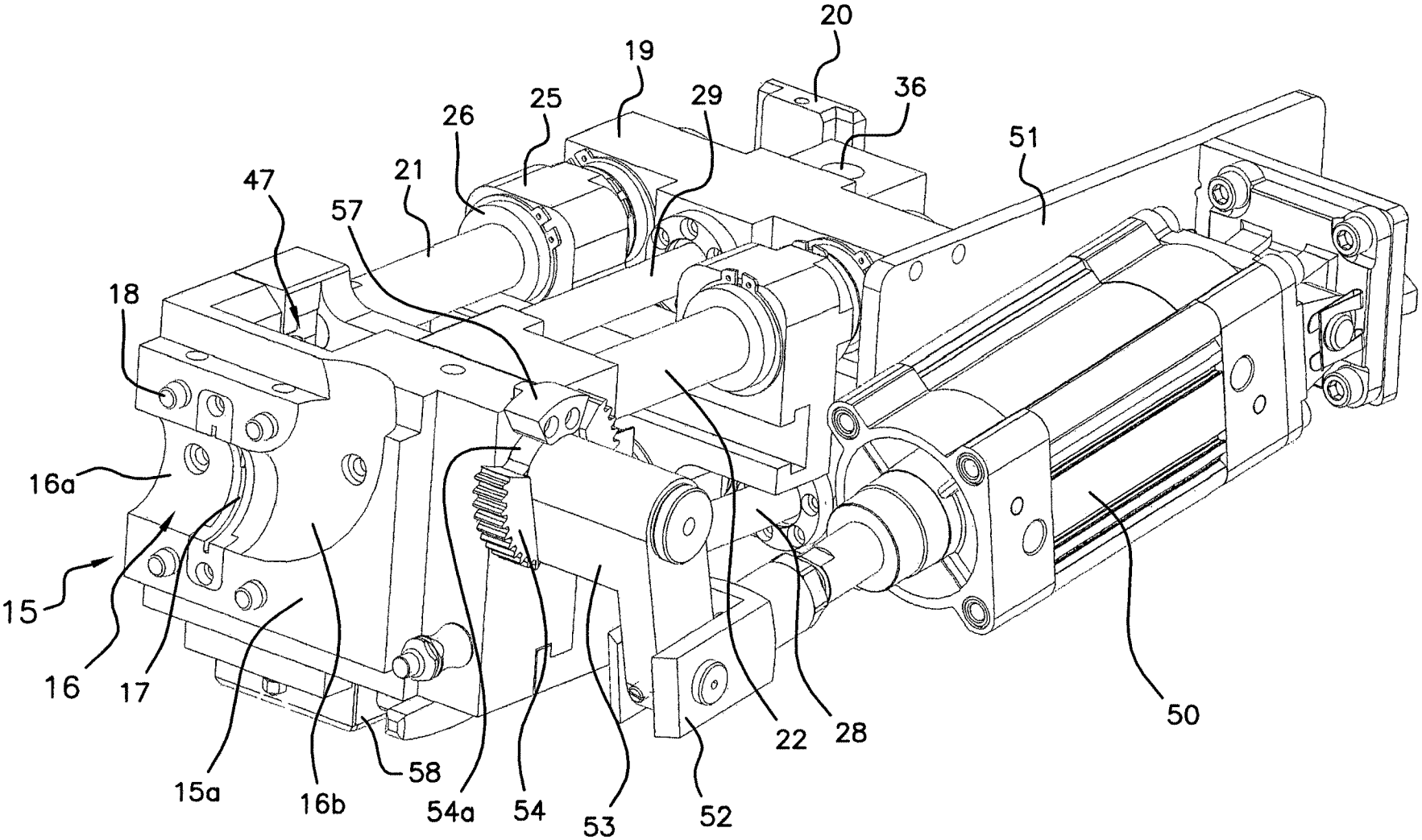
FIG. 3 is a view in perspective of a blank holder jaw/support means assembly of this blank holder jaw according to a first variant embodiment of a bending device according to the invention.
Figure 4:
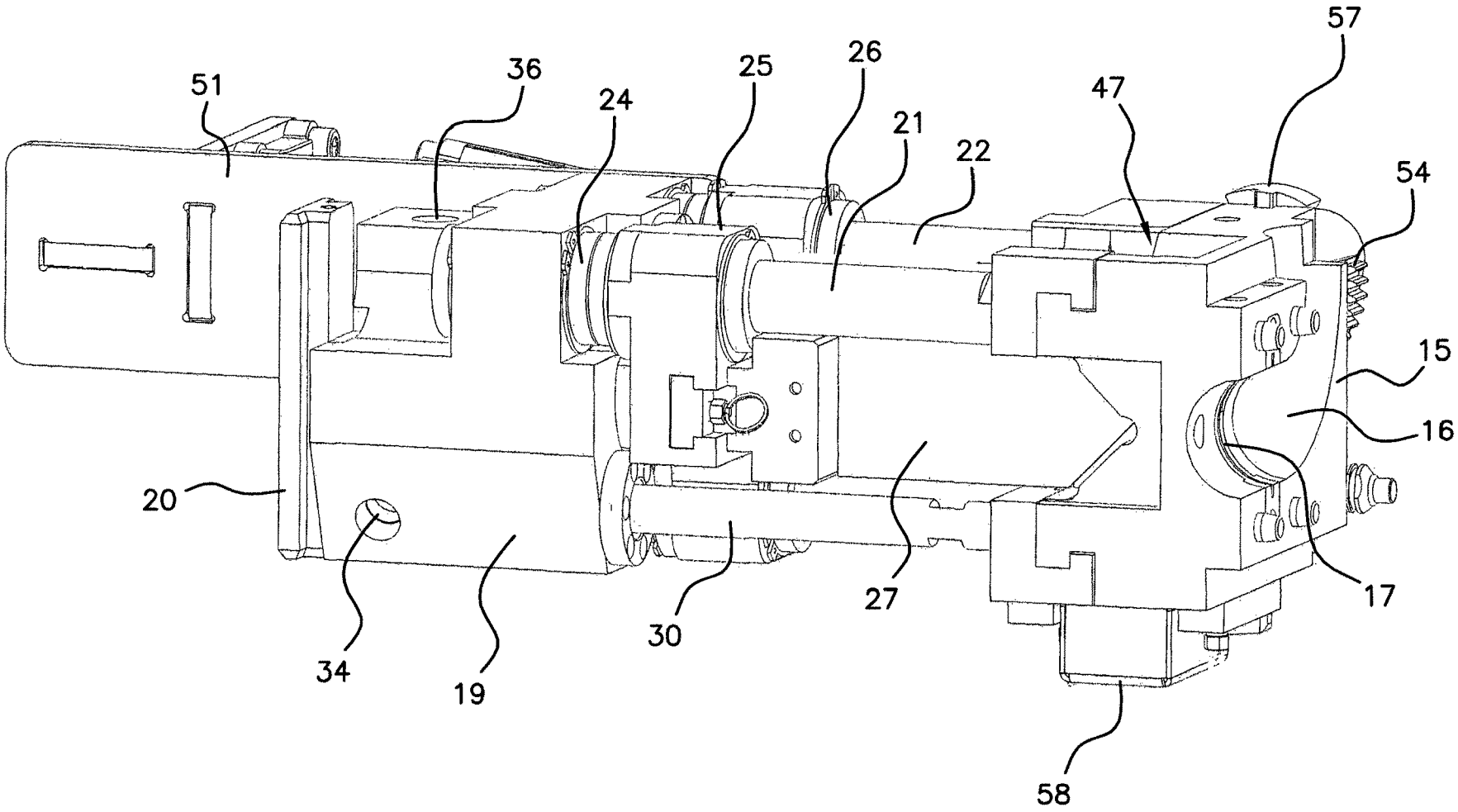
FIG. 4 is a longitudinal lateral view, with partial cutaways, of this blank holder jaw/support means assembly of the blank holder jaw.
Figure 5:
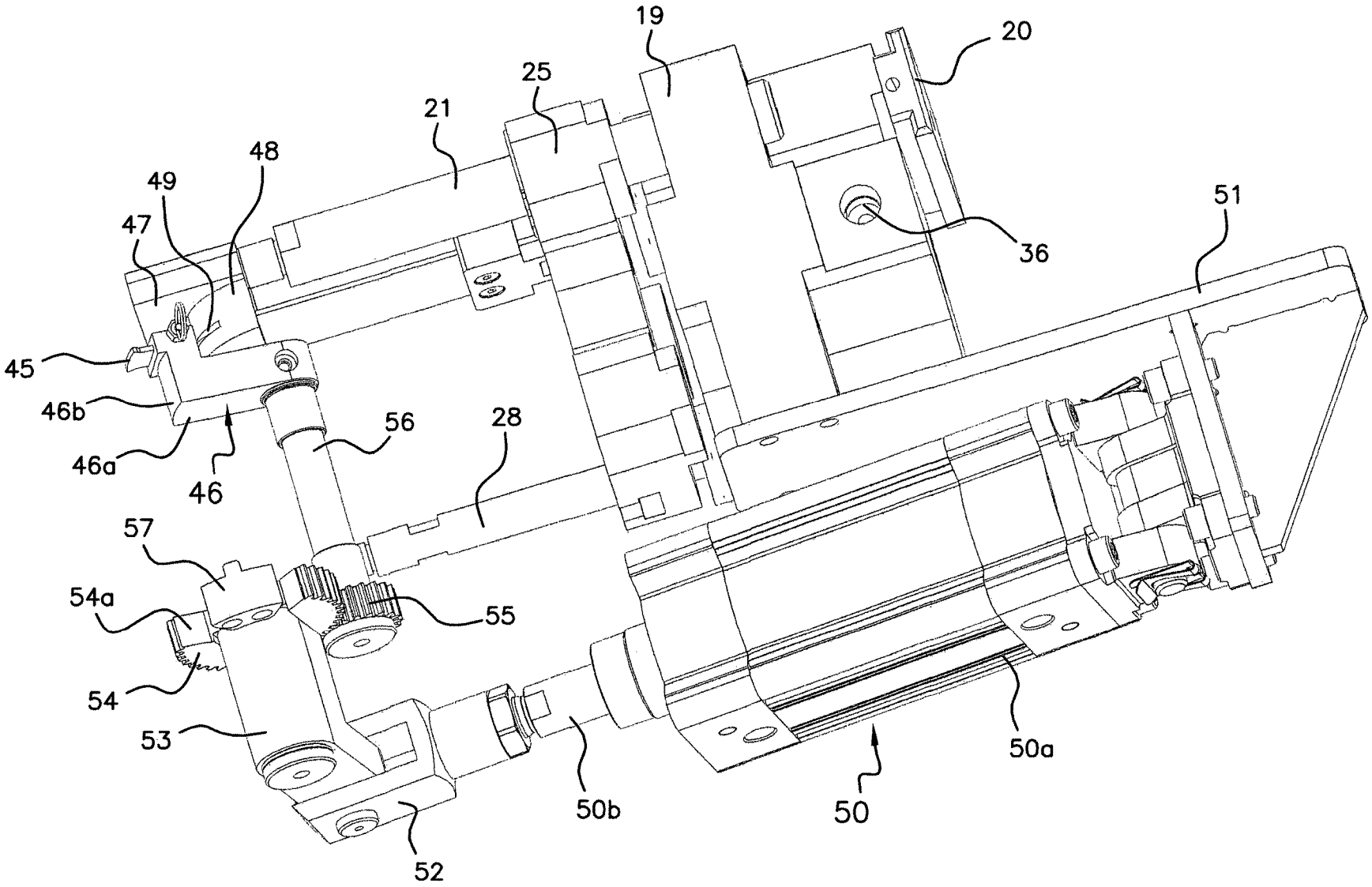
FIG. 5 is a longitudinal side view of this blank holder jaw/support means assembly of the blank holder jaw.
Figure 6:
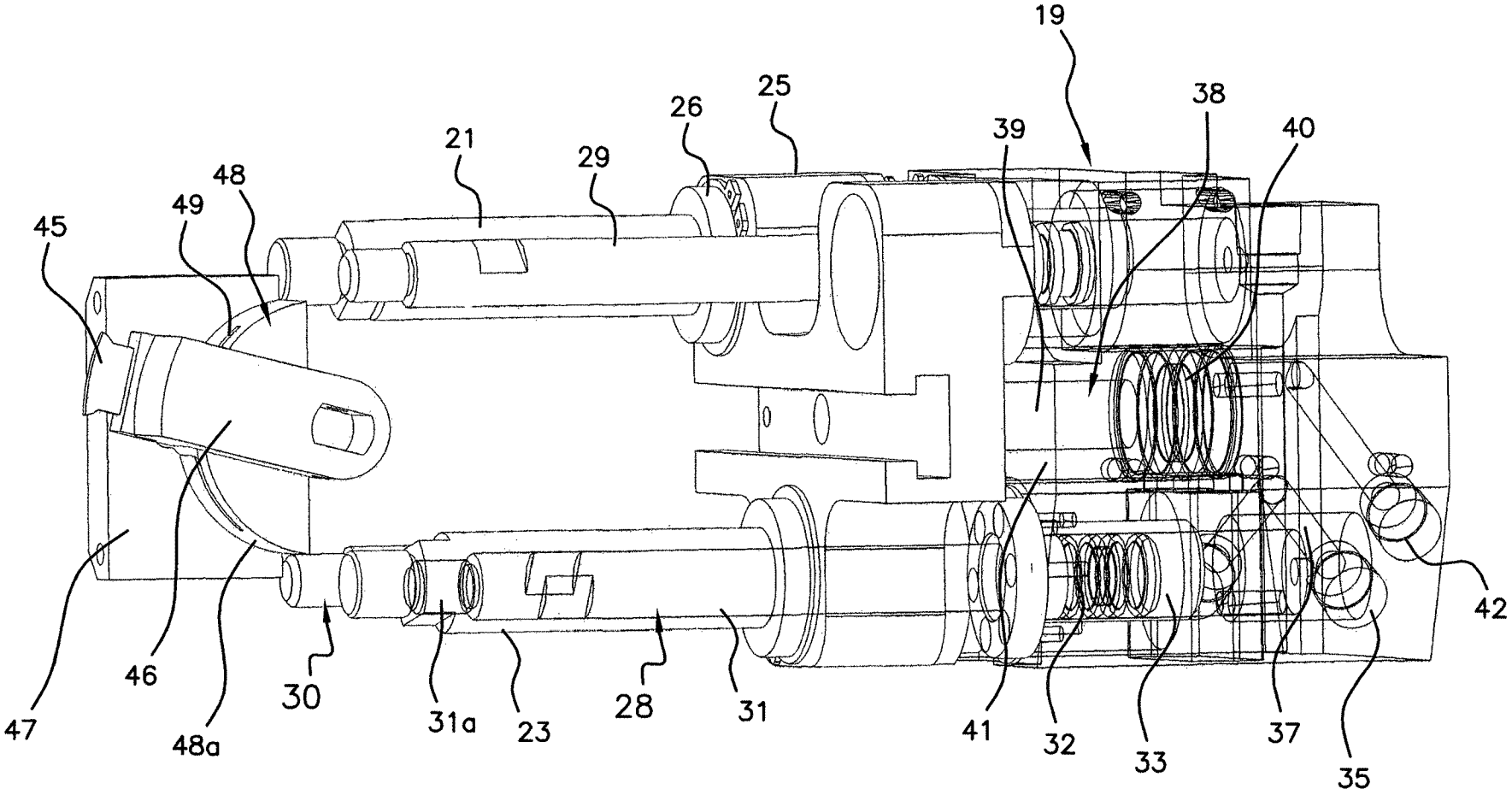
FIG. 6 is a view in perspective with partial cutaways of this blank holder jaw/support means assembly, on which the feeding circuit of the stop cylinders is diagrammatically represented.
Figure 7:
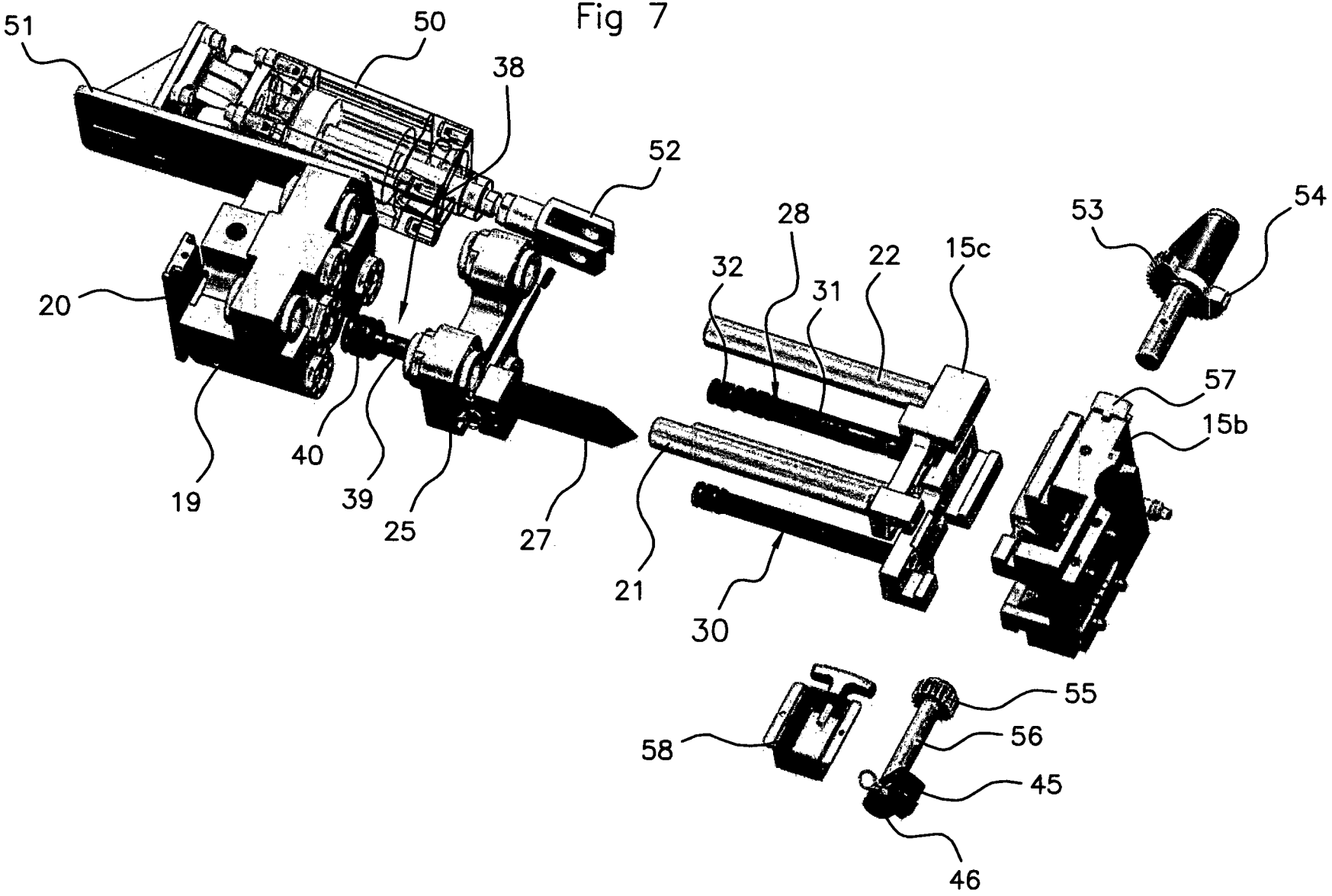
FIG. 7 is an exploded view of the blank bolder jaw split into two blocks.

Moreover, as shown in particular in FIG. 7, the blank holder jaw 15 is split into two blocks 15*b*, 15*c* designed to:

- impart a detachable character to the blank holder jaw making it possible to change the shape of the impression 16,
- delimit a chamber 47 communicating with the slot 17 that opens out into the impression 16, forming a channel designed to ensure the guiding of a pre-cutting element 45 having a cutting end forming at least one cutting tip, activated so as to be moved in a plane (Y, Z):
  - between two positions, called high and low, in each of which it clears the access to the slot 17, of the blank holder jaw 15,
  - along a circular path centered on a point located on the transverse axis (Y), designed so that each cutting tip penetrates into the impression 16 through the slot 17, to a depth designed to achieve a start of the cutting of the profile at least in the vicinity of the generatrix of the latter extending into the plane (X, Y).

In addition, the chamber 47 is delimited subsequently by—by a wall 48 provided with a convex front face 48*a* forming a guiding range for the pre-cutting element 45—the wall being pierced by a slot 49 that extends into the plane (Y, Z), for guiding the cutting element 27.

The activation means of the pre-cutting element 45 have, with regard to them:

- a driven crankshaft 46 on which the pre-cutting element is mounted, whose crank pin 56 consists of a shaft extending along an axis (X), on the end of which is mounted a pinion 55,
- a driven crankshaft 53 on which a driving pinion 54 is mounted that is designed to mesh with the pinion 55 of the driven crankshaft 46, and whose crank pin is activated by a cylinder 50 whose rod 50*b* is equipped with a clevis 52 on the inside of which the crank pin is hinged, and whose body 50*a* is secured on a plate 51 that is attached to one of the lateral longitudinal walls of the holder block 19.

Furthermore, the drive pinion 54 has a V-shaped notch 54*a* on the inside of which a stationary stop 57 that also has a V-shape is positioned.

The assembly of these activation means, and particularly the angle at the top of this notch 54*a*, the shape of the stop 57 and the arrangement of the cylinder 50, are designed so that the rotations of the drive pinion 54, produced by the activation of the cylinder 50, drive movements of the pre-cutting element 45 between its high position in the retracted state of the cylinder 50, and its low position in the deployed state of the cylinder 50.

The operation of this first embodiment of the invention is described below with reference to FIGS. 9*a* to 9*c*.

Firstly, as shown in FIG. 9*a*, during the movement of the holder block 19 that aims to draw together the blank holder jaw 15 to the clamping jaw 10 and then during the bending operation performed in the coupled position of the blank holder jaw and clamping jaw, the distributor 43 is switched into its position for holding the cutting blade 27 in its retracted position, and the cylinder 50 is held in its retracted state to which the high position of the pre-cutting element 45 corresponds.

Once the bending has been performed, as shown in FIG. 9*b*, the cylinder 50 is deployed, driving the movement of the pre-cutting element 45 toward its low position along a path that creates a beginning of the cutting of the profile.

After achieving this beginning of the cutting, and as shown in FIG. 9*c*, an additional movement of the holder block 19 is controlled, after switching of the distributor 43 into its position that is able to produce a relative movement of the carriage 25 in relation to the holder block 19, and, consequently, a movement of the cutting blade 27 driving the cutting of the profile. At the same time, the feeding of the cylinder 50 is designed so that the movement of the holder block 19 to which the body 50*a* of the cylinder is secured drives the retraction of this cylinder 50. Thus, this cylinder 50 applies a force for holding the blank holder jaw 15 against the clamping jaw 10.

The next step, controlled once the cutting of the profile has been performed, consists in controlling the backward movement of the holder block 19, a backward movement during which the blank holder jaw 15 is held against the clamping jaw 10 by the cylinder 50 that is fed so as to be deployed because of the backward movement of the holder block 19. At the same time, the distributor 43 is again switched so that the initial backward movement of the holder block 19, performed with the blank holder jaw 15 that is held against the clamping jaw 10 by the cylinder 50, leads to a relative drawing-together of the carriage 25 and of the holder block 19 and consequently to a retraction of the cutting blade 27.

Finally, the last step consists in controlling a feeding of the cylinder 50 that is designed to drive the retraction of the cylinder, and therefore to drive the movement of the pre-cutting element 45 toward its initial high position shown in FIG. 9*a*.

According to the second embodiment shown in FIG. 10, the blank holder jaw 61 has, like its predecessor, a front face in which a clamping impression 62 is provided in which a slot 63 opens out that communicates with a chamber for guiding a pre-cutting element (not shown in FIG. 10).

According to this embodiment, the blank holder jaw 61 is secured on a carriage 64, in the example shown in the form of a plate, whose movements are designed to make it possible to bring the blank holder jaw either into a clamping position coupled to the bending form 10, or into an open position separated from this bending form.

In addition, the cutting element 66 consists of a cutting blade similar to the one described above, carried by a holder block 65 associated with means for driving the holder block that are able to move it along the transverse axis (Y) along the carriage 64, between an active position for cutting a profile housed in the impressions 11, 62 of the blank holder jaw 61/bending form 10 pair, and a passive position for bending, in which the cutting blade is retracted back in relation to the impressions.

In the example shown, these means for driving the holder block 65 consist of a ball screw 70 that is integral with the holder block, which is driven, by means of a transmission formed by two pinions 68, 69, by an electric motor 67.

According to this embodiment, in addition, the means for moving the pre-cutting element comprise:

a cam with groove 72 made in a plate 71 attached laterally on the holder block 65, so that the groove extends laterally in relation to the cutting element 66, between the holder block and the blank holder jaw 61, a crankshaft 77 connecting the cutting element to a roller 76 housed in the groove of the cam 72, designed to transform the translational movement of the roller guided by the cam with groove 72 into a rotational movement of the pre-cutting element.

In addition, the groove of the cam with groove is composed of two parallel end segments 73, 74 that extend along axes (y) and that are offset in relation to one another along an axis (z), connected by an inclined segment 73 that determines the amplitude of the rotation of the crankshaft 77.

According to this embodiment, in the coupled position of the bending form 10 and of the blank holder jaw 6, the beginning of the cutting and then the cutting are performed by controlling the activation of the electric motor 67, so as to cause successively:

the activation of the pre-cutting element resulting from the rotation of the crankshaft 77 caused by the movement of the roller 76 in the groove 73-75 of the cam with groove 72, the introduction of the cutting blade 66 into the impressions 11, 63 and then the retraction of this cutting blade 66 during the initial backward movement of the holder block 65, and finally the return of the pre-cutting element into its initial position during the continued backward movement of the holder block 65.

The two embodiments of the invention described above therefore provide bending devices designed so as to reduce the time of the final cutting step of this profile, and to perform, during this final step, a clean and straight cutting of the profile.

The invention claimed is:

1. A device for bending profiles such as tubes, which are moved oriented along a longitudinal axis (X), comprising:

a bending die mounted on an apparatus for driving in rotation the bending die around a bending axis (Z) perpendicular to the longitudinal axis (X) for moving the bending profiles, a bending form oriented on the bending axis (Z), provided with a peripheral groove for winding a profile that extends into a continuity of an impression for clamping of the profile, a clamping jaw associated with the bending form having a clamping impression of a complementary profile of the impression of the bending form, an apparatus for moving the clamping jaw along a transverse axis (Y) perpendicular to the bending axis (Z), relative to the associated bending form, between a clamping position coupled to the bending form and an open position separated from the bending form, the clamping jaw is pierced with a through hole that opens out through a slot in the clamping impression of the clamping jaw, the bending form associated with the clamping jaw is pierced with a through hole that opens out through a slot in the impression of the bending form, and arranged so as to extend into a continuity of the slot of the clamping jaw, a cutting element associated with each of the clamping jaw and bending form pair, the cutting element having one cutting end forming a cutting tip extending into a plane (X, Y), an apparatus for moving the cutting element along the transverse axis (Y) between an active cutting position of a profile housed in the clamping impression and impressions of the associated clamping jaw and bending form pair, and a passive position, called a bending position, in which the cutting element is retracted back in relation to the clamping impression and impressions, the bending device further comprises, associated with the clamping jaw and bending form pair, a pre-cutting element activated before the cutting element and having a cutting end that forms a cutting tip, and an apparatus for moving the pre-cutting element in the plane (Y, Z):

between two positions in each of which the pre-cutting element clears an access to the slot that opens out into the clamping impression of the clamping jaw, along a path so that each cutting tip penetrates into the clamping impression of the clamping jaw through the slot by a depth to achieve a beginning of the cutting of the profile at least in a vicinity of a generatrix of the latter that extends into the plane (X, Y), the clamping jaw having, communicating with the clamping impression of the clamping jaw through the slot opening out into the latter, a channel to ensure guiding of the pre-cutting element during movement of the latter, and the apparatus for moving the cutting element determines a bending position in which the cutting element is retracted back from the guiding channel the pre-cutting element.

2. The bending device according to claim 1, wherein the apparatus for moving the pre-cutting element moves the latter along a circular path centered on a point located on the transverse axis (Y).

3. The bending device according to claim 2, wherein the guiding channel of each pre-cutting element is delimited, along the transverse axis (Y), by a convex wall forming a guiding range of the pre-cutting element, pierced with a slot extending into the plane (Y, Z), for guiding the cutting element.

4. The bending device according to claim 1, wherein an apparatus for moving the clamping jaw has a carriage on which the clamping jaw is mounted, and an apparatus for moving in translation the carriage along the transverse axis (Y), wherein the cutting element and the pre-cutting element are mounted on the carriage and are associated a movement apparatus that moves them along the transverse axis (Y) relative to the carriage.

5. The bending device according to claim 4, wherein:

the cutting element is carried by a holder block associated with an apparatus for moving the holder block along the transverse axis (Y) relative to the carriage, the apparatus for moving the pre-cutting element comprises a connecting rod system connecting the cutting element to a roller that works with a cam mounted on the holder block.

6. The bending device according to claim 5, wherein the cam comprises a cam with a groove extended laterally in relation to the cutting element, between the holder block and the clamping jaw, the connecting rod system having a crankshaft able to transform translational movement of the roller guided by the cam into a rotational movement of the pre-cutting element.

7. The bending device according to claim 1, in which the clamping jaw is coupled to a support device:

with which are associated the apparatus for moving the clamping jaw along the transverse axis (Y), on which the cutting element is mounted, to which the clamping jaw is connected by retractable connecting elements between a retracted state in which the cutting element is in its active cutting position, and a deployed state in which the cutting element is in its retracted passive position, the bending device having the pre-cutting element associated with a movement apparatus comprising an actuator to produce movements of the pre-cutting element.

8. The bending device according to claim 7, further comprising an apparatus for controlling the actuator to control a movement of the pre-cutting element along an outward path, to perform the pre-cutting, and then to control the movement along the return path, after activating the cutting element.

9. The bending device according to claim 8, wherein the actuator consists of a fluid cylinder coupled respectively to the support device of the cutting element and to the clamping jaw, and configured so that its deployment produces a movement along an outward path of the pre-cutting element, or to exert a stop force against clamping jaw, firstly in its deployed state, and secondly during its retracted state and its deployed state resulting from the movements of the support device of the cutting element relative to the clamping jaw producing the cutting of the profile.

10. The bending device according to claim 9, wherein each cutting element is carried by a carriage coupled to a holder block with which are associated the apparatus for moving the clamping jaw along the transverse axis (Y), the retractable connecting elements placed between the clamping jaw and the support device of the cutting element comprise:

at least one stop cylinder, extending longitudinally between the clamping jaw and the holder block, a cutting cylinder resting against the carriage carrying the cutting element so, during the deployment of the cutting cylinder, a force is exerted on the carriage that tends to loosen the cutting cylinder from the holder block, an apparatus for feeding the cutting cylinder and each stop cylinder, comprising a closed circuit so that the cutting cylinder and each stop cylinder are fed inversely.

* * * * *